US009022537B2

(12) United States Patent
Uchiyama

(10) Patent No.: US 9,022,537 B2
(45) Date of Patent: May 5, 2015

(54) LIQUID EJECTING APPARATUS AND LIQUID SUPPLYING METHOD FOR LIQUID EJECTING APPARATUS

(71) Applicant: Seiko Epson Corporation, Tokyo (JP)

(72) Inventor: Masaki Uchiyama, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/198,144

(22) Filed: Mar. 5, 2014

(65) Prior Publication Data

US 2014/0292952 A1 Oct. 2, 2014

(30) Foreign Application Priority Data

Mar. 28, 2013 (JP) ..... 2013-068273

(51) Int. Cl.
*B41J 2/175* (2006.01)

(52) U.S. Cl.
CPC ..... *B41J 2/17509* (2013.01); *B41J 2/17566* (2013.01); *B41J 2/17596* (2013.01)

(58) Field of Classification Search
CPC ..... B41J 2/17503; B41J 2/17506; B41J 2/17556; B41J 2/17566; B41J 2/17596; B41J 2/18; B41J 2/211; B41J 2/2114; B41J 2/2117; B41J 2/17509
USPC ..... 347/7, 14, 19, 84–86, 89
See application file for complete search history.

(56) References Cited

U.S. PATENT DOCUMENTS

| | | | | |
|---|---|---|---|---|
| 7,455,395 | B2 * | 11/2008 | Wilson et al. | 347/85 |
| 8,061,822 | B2 * | 11/2011 | Kubo et al. | 347/85 |
| 2009/0251506 | A1 | 10/2009 | Ohnishi et al. | |

FOREIGN PATENT DOCUMENTS

| | | |
|---|---|---|
| JP | 2000-015837 | 1/2000 |
| JP | 2002-052731 | 2/2002 |
| JP | 2004-098365 | 4/2004 |
| JP | 2004-230857 | 8/2004 |
| JP | 2009-035672 | 2/2009 |

* cited by examiner

*Primary Examiner* — Juanita D Jackson
(74) *Attorney, Agent, or Firm* — Workman Nydegger

(57) ABSTRACT

A liquid ejecting apparatus includes: a liquid ejecting head that ejects liquid which is supplied from two or more liquid housing portions that house liquid; two or more housing portion side flow paths which are provided to correspond with each of the liquid housing portions and which supply liquid from an upstream side that is a side of the liquid housing portions to a downstream side; and a flow mechanism which is capable of causing liquid to flow in the housing portion flow paths, and the flow mechanism causes liquid to flow in a housing portion side flow path corresponding with a liquid housing portion that does not supply liquid for a predetermined time set in advance among the housing portion side flow paths.

5 Claims, 2 Drawing Sheets

LIQUID EJECTING APPARATUS AND LIQUID SUPPLYING METHOD FOR LIQUID EJECTING APPARATUS

BACKGROUND

1. Technical Field

The present invention relates to a liquid ejecting apparatus that supplies liquid housed in a liquid housing portion via flow paths to a liquid ejecting head and a liquid supplying method for the liquid ejecting apparatus.

2. Related Art

A printer (liquid ejecting apparatus) which supplies ink (liquid) housed in an exchangeable cartridge (liquid housing portion) to a liquid ejecting head and ejects ink to a target from the liquid ejecting head to perform printing has been known (see JP-A-2004-98365).

In such a printer, even when liquid that has been housed in the cartridge is run out of, it is possible to perform printing by exchanging the cartridge with new one. However, when it is necessary to exchange cartridges during printing, printing must be interrupted. Then, there cause mottled patterns in printing matters and printing quality may be reduced.

Accordingly, a printer is proposed in which a plurality of cartridges are coupled to the liquid ejecting head, and even when ink housed in one cartridge is run out of, it is possible to supply ink from another cartridge and continue printing.

There is a type of ink such as pigment ink which causes precipitation or aggregation as time passes and causes concentration imbalance. Therefore, when such ink is supplied to the liquid ejecting head, there sometimes causes concentration imbalance in ink in a flow path which couples the liquid ejecting head to the cartridge.

That is, when a plurality of cartridges are coupled, ink flows in a flow path which couples the cartridge for supplying ink (supply liquid housing portion) and the liquid ejecting head. Therefore, concentration imbalance in ink in a flow path is not easily caused. However, since in a flow path (housing portion side flow path) corresponding to another cartridge (non-supply liquid housing portion), ink stagnates to be stopped, and concentration imbalance is easy to be caused.

Note that such a problem is not limited to a printer which supplies ink housed in the cartridge to the liquid ejecting head via a flow path. That is, such a problem is generally common to the liquid ejecting apparatus that supplies liquid housed in the liquid housing portion to the liquid ejecting head via flow paths and the liquid supplying method for the liquid ejecting apparatus.

SUMMARY

An advantage of some aspects of the invention is to provide a liquid ejecting apparatus which can reduce concentration imbalance in liquid in a housing portion side flow path and a liquid supplying method for the liquid ejecting apparatus.

According to an aspect of the invention, a liquid ejecting apparatus includes: a liquid ejecting head that ejects liquid which is supplied from two or more liquid housing portions that house liquid; two or more housing portion side flow paths which are provided to correspond with the liquid housing portions and which supply liquid from an upstream side that is a side of the liquid housing portions to a downstream side that is an opposite side to the liquid housing portions; a head side flow path which supplies liquid supplied by each of the housing portion side flow paths further to a downstream side that is a side of the liquid ejecting head; and a flow mechanism which can cause liquid to flow in the housing portion flow paths, and the flow mechanism causes liquid to flow in a housing portion side flow path corresponding with a liquid housing portion that does not supply liquid for a predetermined time set in advance among the housing portion side flow paths.

Concentration imbalance in liquid in the flow paths gradually becomes large according to a length of stopping time. Therefore, in the housing portion side flow paths corresponding to the liquid housing portions that do not supply liquid for a predetermined time, there is a fear of concentration imbalance in liquid becoming large. With respect to this point, according to this configuration, as the flow mechanism causes liquid to flow in the housing portion side flow paths, it is possible to reduce the concentration imbalance in liquid in the housing portion side flow paths.

It is preferable that, in the liquid ejecting apparatus, the flow mechanism cause the liquid in the housing portion side flow paths to flow from an upstream side to a downstream side.

According to this configuration, by causing liquid to flow from an upstream side to a downstream side, it is possible to cause liquid to largely flow in comparison with a case where liquid flows in the housing portion side flow paths. Therefore, it is possible to effectively reduce concentration imbalance in liquid.

It is preferable that the liquid ejecting apparatus further include: a residual amount detector which detects a residual amount of liquid housed in the liquid housing portion; and a selector which selects the liquid housing portion that supplies liquid to the liquid ejecting head. The selector may select in the liquid housing portions, as a liquid housing portion which supplies liquid to a side of the liquid ejecting head, both a small amount liquid housing portion in which the residual amount of housed liquid is less than or equal to the threshold of residual amount and a large amount liquid housing portion in which the residual amount of housed liquid is larger than the threshold of residual amount.

Concentration of liquid that is supplied from the liquid housing portions sometimes varies depending on a residual amount of liquid that is housed in the liquid housing portions. That is, in the case where a residual amount is large, liquid whose concentration is lower than that in the case where the residual amount is small may be supplied. With respect to this point, according to this configuration, by supplying liquid from a small amount liquid housing portion in which the residual amount of liquid is less than or equal to the threshold of residual amount and a large amount liquid housing portion in which the residual amount of liquid is larger the threshold of residual amount, it is possible to mix liquids whose concentrations are different to each other and supply the mixed liquid to the liquid ejecting head.

It is preferable that, in the liquid ejecting apparatus, the flow mechanism, when the residual amount of liquid housed in the liquid housing portions is larger than the threshold of residual amount, cause the liquid to flow in the housing portion side flow path corresponding to the liquid housing portion when time that liquid is not supplied has elapsed for a predetermined time.

According to this configuration, since liquid flows in the housing portion side flow paths corresponding to the liquid housing portions when time that ink is not supplied has elapsed for a predetermined time, it is possible to suppress concentration imbalance in liquid in the housing portion side flow paths. Therefore, when the residual amount of liquid becomes small in the liquid housing portions, and liquid is supplied from the large amount liquid housing portion, it is possible to supply liquid whose concentration imbalance is suppressed.

According to another aspect of the invention, a liquid supplying method for the liquid ejecting apparatus includes: supplying liquid via a supply liquid housing portion which supplies liquid to a liquid ejecting head among two or more liquid housing portions that house liquid, a housing portion side flow path corresponding to the supply liquid housing portion, and a head side flow path on a side closer to the liquid ejecting head than the housing portion side flow path; measuring time when liquid is not supplied from a non-supply liquid housing portion that is different from the supply liquid housing portion among the liquid housing portions; and causing liquid to flow in a housing portion side flow path corresponding to the non-supply liquid housing portion when time measured in the measuring is longer than a predetermined time set in advance.

According to this configuration, it is possible to achieve effects similar to those of the above described liquid ejecting apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of an ink jet printer which is an example of a liquid ejecting apparatus will be explained with reference to the drawings.

Figure 1:
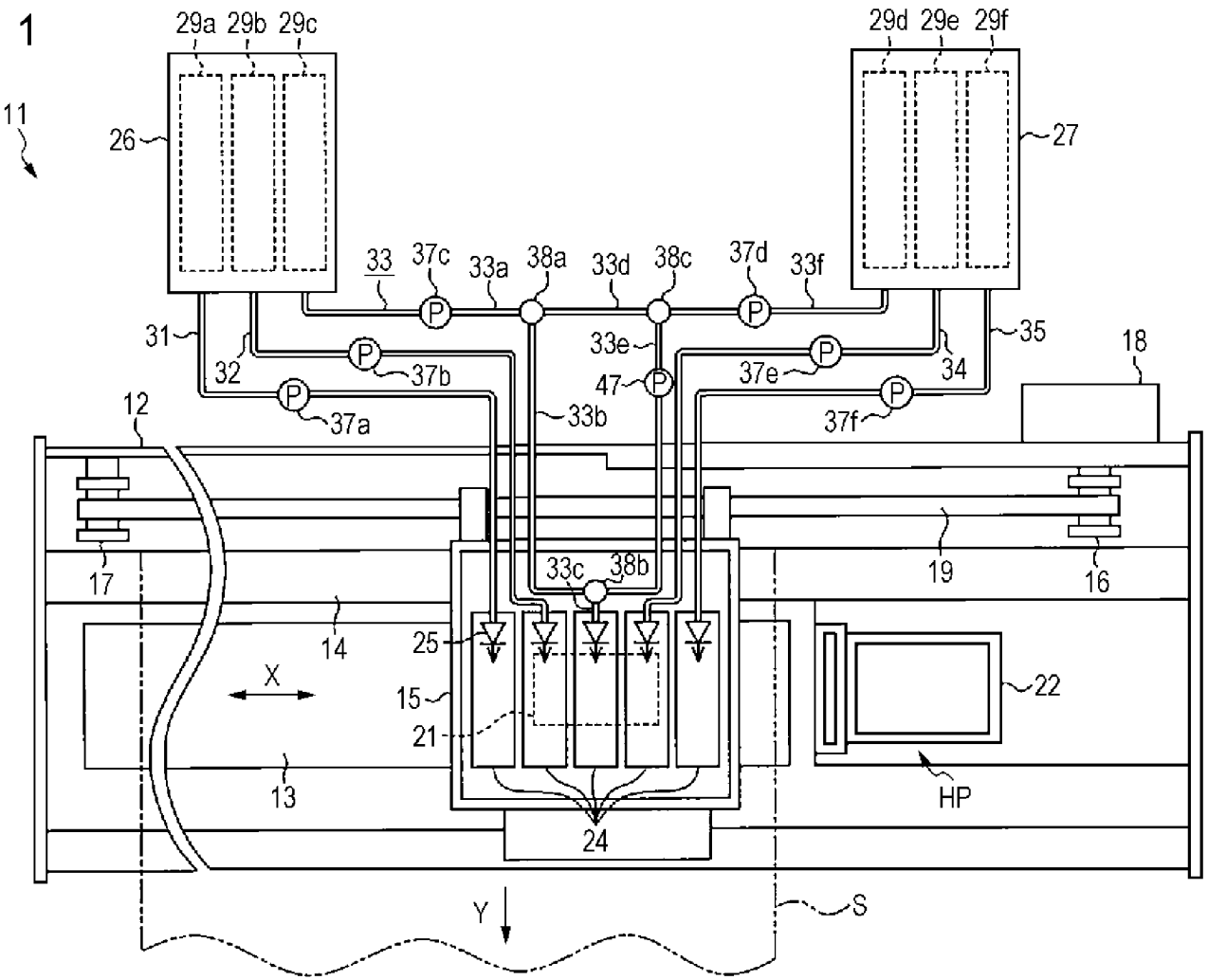
FIG. 1 is a schematic diagram of a printer of an embodiment.

As illustrated in FIG. 1, an ink jet printer (hereinafter, referred to simply as a "printer") 11 as an example of the liquid ejecting apparatus has a body case 12 which has an approximately rectangular box shape. A support member 13 is installed along a longitudinal direction (a right and left direction in FIG. 1) of the body case 12 which is a main scanning direction X on a forward lower end of the body case 12. A recording paper S is fed along a sub-scanning direction Y which is perpendicular to the main scanning direction X by a paper feed mechanism (not shown) on the support member 13.

A bar shape guide shaft 14 is installed along the main scanning direction X in the upward rear of the support member 13 in the body case 12. Further, on the guide shaft 14, a carriage 15 is supported. On a backward side face of the body case 12, a drive pulley 16 and a driven pulley 17 are rotatably supported in a location corresponding to both end portions of the guide shaft 14. A carriage motor 18 is coupled to the drive pulley 16 and an endless timing belt 19 to which the carriage 15 is coupled is provided to extend between the pair of the pulleys 16 and 17. Then, the carriage 15 is driven by the carriage motor 18 and moves back and forth along the guide shaft 14 in the main scanning direction X.

On a lower side of the carriage 15, a liquid ejecting head 21 in which a plurality of nozzles (not shown) for ejecting ink as an example of liquid are formed is attached. Further, in a range of the carriage 15 moving in the main scanning direction X, a home position HP which is a retreat position of the liquid ejecting head 21 is provided. Below the home position HP, a maintenance mechanism 22 for performing maintenance of the liquid ejecting head 21 is installed.

Further, on the carriage 15, at least one (five in this embodiment) valve unit 24 for supplying ink at pressure appropriate for ejection to a nozzle which is formed on the liquid ejecting head 21 is provided. On the valve unit 24, a pressure adjustment valve 25 that opens when ink has been ejected through the nozzle and pressure of ink on a downstream side that is a side of the liquid ejecting head 21 is lowered is provided. That is, the pressure adjustment valve 25 functions as a so-called self-sealing valve for supplying ink from an upstream side to a downstream side by opening in accordance with consumption of ink on the liquid ejecting head 21.

On the printer 11, at least one cartridge holder (two cartridge holders 26 and 27 in this embodiment) which has a box shape is provided. Further, on each of the cartridge holders 26 and 27, at least one ink cartridge (three ink cartridges 29*a* to 29*c* and 29*d* to 29*f* in this embodiment) as an example of a liquid housing portion can be mounted.

Further, in this embodiment, yellow ink is housed in the first ink cartridge 29*a* and black ink is housed in the second ink cartridge 29*b*. Then, white ink is housed in the third ink cartridge 29*c* and in the fourth ink cartridge 29*d*. Furthermore, magenta ink is housed in the fifth ink cartridge 29*e* and cyan ink is housed in the sixth ink cartridge 29*f*.

Ink which is housed in the ink cartridges 29*a* to 29*f* is pigment ink which has a possibility of pigment particles precipitating in ink solvent as time passes. A degree of precipitation depends on the kinds of ink. In the above-described kinds of ink, white ink is most easy to precipitate in comparison with the others.

An upstream end of at least one ink supply tube (five ink supply tubes 31 to 35 in total in this embodiment) is coupled to each of the cartridge holders 26 and 27. On the other hand, downstream ends of the respective ink supply tubes 31 to 35 are individually coupled to pressure adjustment valves 25. Further, on the ink supply tubes 31 to 35, feed pumps 37*a* to 37*f* for feeding ink which has been housed in the respective ink cartridges 29*a* to 29*f* to a downstream side are provided so as to correspond with the respective ink cartridges 29*a* to 29*f*.

That is, for example, ink which has been housed in the first ink cartridge 29*a* is supplied to the liquid ejecting head 21 via the first ink supply tube 31 and the valve unit 24 by driving the first feed pump 37*a*. Further, ink which has been housed in the second ink cartridge 29*b* is supplied to the liquid ejecting head 21 via the second ink supply tube 32 and the valve unit 24 by driving of the second feed pump 37*b*.

Similarly, ink which has been housed in the fifth ink cartridge 29*e* is supplied to the liquid ejecting head 21 via the fourth ink supply tube 34 and the valve unit 24 by driving of the fifth feed pump 37*e*. Further, ink which has been housed in the sixth ink cartridge 29*f* is supplied to the liquid ejecting head 21 via the fifth ink supply tube 35 and the valve unit 24 by driving of the sixth feed pump 37*f*.

Next, the third ink supply tube 33 for supplying ink which has been housed in the third ink cartridge 29*c* and the fourth ink cartridge 29*d* to the liquid ejecting head 21 side will be explained. Note that the third ink supply tube 33 is composed of a plurality of tubes 33*a* to 33*f* being coupled to each other via coupling portions 38*a* to 38*c* such as three way tubes.

In the first tube 33*a*, the upstream end is coupled to the first cartridge holder 26 so as to correspond with the third ink cartridge 29*c* and the downstream end is coupled to the first coupling portion 38*a*. In the second tube 33*b*, the upstream end is coupled to the first coupling portion 38*a* and the downstream end is coupled to the second coupling portion 38*b*.

In the third tube 33*c*, the upstream end is coupled to the second coupling portion 38*b* and the downstream end is coupled to the pressure adjustment valve 25. In the fourth tube 33*d*, one end (left end in FIG. 1) is coupled to the first coupling portion 38*a* and the other end (right end in FIG. 1) is coupled to the third coupling portion 38*c*.

In the fifth tube 33*e*, the upstream end is coupled to the third coupling portion 38*c* and the downstream end is coupled to the second coupling portion 38*b*. In the sixth tube 33*f*, the upstream end is coupled to the second cartridge holder 27 so as to correspond with the fourth ink cartridge 29*d* and the downstream end is coupled to the third coupling portion 38*c*.

Further, in the first tube 33*a*, the third feed pump 37*c* which is driven when ink that has been housed in the third ink cartridge 29*c* is supplied to a downstream side is provided. Similarly, in the sixth tube 33*f*, the fourth feed pump 37*d* which is driven when ink that has been housed in the fourth ink cartridge 29*d* is supplied to a downstream side is provided. Furthermore, in the fifth tube 33*e*, a circulation pump 47 for circulating ink in the second tube 33*b*, the fourth tube 33*d*, and the fifth tube 33*e* is provided.

Figure 2:
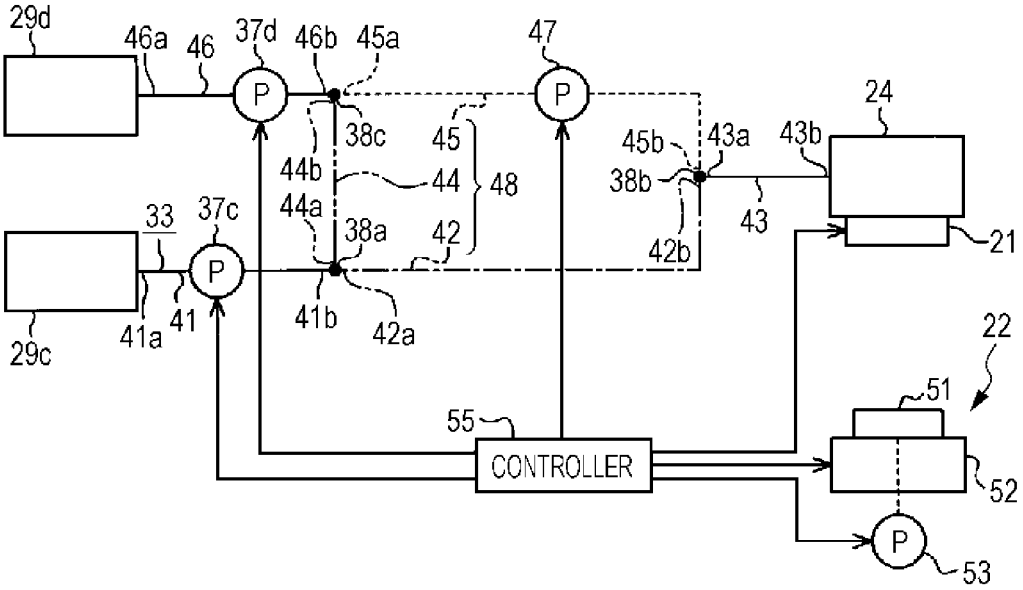
FIG. 2 is a schematic diagram of a flow path which a third ink supply tube constitutes.

FIG. 2 illustrates flow paths 41 to 46 which are constituted by the first tube 33*a* to the sixth tube 33*f* in the third ink supply tube 33 by varying types of lines among adjacent flow paths. That is, the first tube 33*a* constitutes the first flow path 41 indicated by a solid line, the second tube 33*b* constitutes the second flow path 42 indicated by a dashed line, the third tube 33*c* constitutes the third flow path 43 indicated by a solid line. Further, the fourth tube 33*d* constitutes the fourth flow path 44 indicated by a chain double-dashed line, the fifth tube 33*e* constitutes the fifth flow path 45 indicated by a broken line, and the sixth tube 33*f* constitutes the sixth flow path 46 indicated by a solid line.

As illustrated in FIG. 2, an upstream end 41*a* of the first flow path 41 is coupled to the third ink cartridge 29*c* via an ink supply portion (not shown). Further, the first coupling portion 38*a* is coupled to a downstream end 41*b* of the first flow path 41, an upstream end 42*a* of the second flow path 42, and one end of the fourth flow path 44 (lower end in FIG. 2). That is, the first flow path 41, the second flow path 42, and the fourth flow path 44 are coupled via the first coupling portion 38*a* and communicated with each other.

The second coupling portion 38*b* is coupled to a downstream end 42*b* of the second flow path 42, an upstream end 43*a* of the third flow path 43, and a downstream end 45*b* of the fifth flow path 45. That is, the second flow path 42, the third flow path 43, and the fifth flow path 45 are coupled via the second coupling portion 38*b* and communicated with each other. Further, a downstream end 43*b* of the third flow path 43 is coupled to the valve unit 24.

To the third coupling portion 38*c*, the other end (upper end in FIG. 2) 44*b* of the fourth flow path 44, an upstream end 45*a* of the fifth flow path 45, and a downstream end 46*b* of the sixth flow path 46 are coupled. That is, the fourth flow path 44, the fifth flow path 45, and the sixth flow path 46 are coupled via the third coupling portion 38*c* and communicated with each other. Further, an upstream end 46*a* of the sixth flow path 46 is coupled to the fourth ink cartridge 29*d* via an ink supply portion (not shown).

Further, the first flow path 41 and the sixth flow path 46 are provided to be associated with ink cartridge 29*c* and 29*d*, respectively. The first flow path 41 functions as an example of a housing-portion-side flow path in which ink is supplied from an upstream side that is the third ink cartridge 29*c* side to a downstream side that is an opposite side to the third ink cartridge 29*c*. Further, the sixth flow path 46 also functions as an example of a housing-portion-side flow path for supplying ink from an upstream side that is the fourth ink cartridge 29*d* side to a downstream side that is an opposite side to the fourth ink cartridge 29*d*.

A circulation flow path 48 that is composed of the second flow path 42, the fourth flow path 44, and the fifth flow path 45 is provided downstream as compared to the first flow path 41 and the sixth flow path 46. In addition, the circulation flow path 48 is coupled to the downstream end 41*b* of the first flow path 41 and the downstream end 46*b* of the sixth flow path 46 and it is possible to circulate ink which has been supplied from each of the ink cartridges 29*c* and 29*d*.

Further, an upstream end 43*a* of the third flow path 43 is coupled to the circulation flow path 48. Therefore, the third flow path 43 functions as an example of a head side flow path which supplies ink that has been supplied by the first flow path 41 or the sixth flow path 46, and the circulation flow path 48, to a downstream side that is the liquid ejecting head 21 side.

That is, in this embodiment, ink is supplied to the liquid ejecting head 21 from two ink cartridges 29*c* and 29*d* that house the same kind of ink (white ink). Then, ink which has been supplied from the ink cartridges 29*c* and 29*d* is ejected from the same nozzle formed in the liquid ejecting head 21.

As illustrated in FIG. 2, the maintenance mechanism 22 has a cap 51 which can abut against the liquid ejecting head 21 so as to cover the nozzle. Further, the maintenance mechanism 22 has a moving mechanism 52 for moving the cap 51 between an abutting position at which the liquid ejecting head 21 abuts against the cap 51 and a distanced position which is different from the abutting position (a position illustrated in FIG. 2) and a suction pump 53 for sucking inside of the cap 51.

Further, the printer 11 has a controller 55 which controls operation state of the printer 11 overall. Note that the controller 55 controls driving of the liquid ejecting head 21, the carriage motor 18 (see FIG. 1), the moving mechanism 52, and the suction pump 53, and performs processes of ejection of ink to the recording paper S and maintenance of the liquid ejecting head 21 on the basis of programs stored in a storage portion (not shown). Further, the controller 55 controls driving of each of the feed pumps 37*a* to 37*f* and the circulation pump 47, and supplies ink from the ink cartridges 29*a* to 29*f* to the liquid ejecting head 21.

Further, the controller 55 functions as an example of a residual amount detector which detects the residual amount of ink that has been housed in each of the ink cartridges 29*a* to 29*f*. That is, the controller 55 detects the residual amount of ink that is housed in each of the ink cartridges 29*a* to 29*f* based on a state of the ink cartridges 29*a* to 29*f* which supply ink to the liquid ejecting head 21 and ink amount that has been ejected from the liquid ejecting head 21. Note that the controller 55 stores data on the detected residual amount in a storage portion (not shown) in association with each of the ink cartridges 29*a* to 29*f*.

Next, an action at the time of supplying ink from the ink cartridges 29*a* to 29*f* to the liquid ejecting head 21 will be explained with focusing on in particular the action at the time of supplying ink from the third ink cartridge 29*c* and the fourth ink cartridge 29*d*. Here, it is assumed that the first flow path 41 to the sixth flow path 46 are filled with ink as an initial state.

As illustrated in FIG. 2, first, the controller 55 selects a supply cartridge (supply liquid housing portion) for supplying ink to the liquid ejecting head 21 from the third ink cartridge 29*c* and the fourth ink cartridge 29*d*. At this point, the controller 55 functions as an example of the selecting portion.

That is, the controller 55 selects from the ink cartridges 29*c* and 29*d* an ink cartridge in which a housed ink residual amount is the least as a supply cartridge among the ink cartridges excluding the one that has run out of ink. Note that "run out of ink" includes not only the state that ink is not left in the ink cartridge but also the state that ink cannot be supplied from the ink cartridge and the state that suppliable ink is as little as possible.

Further, when the residual amount of the selected ink cartridge is less than or equal to a threshold of residual amount, the controller 55 selects a small amount cartridge (small amount liquid housing portion) in which the residual amount is less than or equal to the threshold of residual amount and a large amount cartridge in which the residual amount is above the threshold of residual amount (large amount liquid housing portion) as supply cartridges.

That is, when the residual amount of the third ink cartridge 29*c* is smaller than that of the fourth ink cartridge 29*d*, the controller 55 selects the third ink cartridge 29*c* as a supply cartridge. Further, at this time, the fourth ink cartridge 29*d* is a non-supply cartridge (non-supply liquid housing portion) which does not supply ink to the liquid ejecting head 21, as different from the third ink cartridge 29*c*.

Further, when the residual amount of the third ink cartridge 29*c* is less than or equal to the threshold of residual amount and the residual amount of the fourth ink cartridge 29*d* is above the threshold of residual amount, the controller 55 selects both of the ink cartridges 29*c* and 29*d* as supply cartridges. That is, in this case, the third ink cartridge 29*c* is a small amount cartridge and the fourth ink cartridge 29*d* is a large amount cartridge.

When the residual amount of the third ink cartridge 29*c* and that of the fourth ink cartridge 29*d* are both less than or equal to the threshold of residual amount, the controller 55 selects one ink cartridge whose residual amount is smaller as a supply cartridge.

Next, the controller 55 supplies ink that has been housed in the supply cartridge to the liquid ejecting head 21. That is, first, the controller 55 drives the circulation pump 47 so that pressure is applied to ink in the fifth flow path 45 from a downstream side to an upstream side. Note that, at this time, driving of the third feed pump 37*c* and the fourth feed pump 37*d* is stopped. Therefore, pressure of ink is maintained between the first coupling portion 38*a* and the third feed pump 37*c*, and between the third coupling portion 38*c* and the fourth feed pump 37*d*. Further, at the time of non-printing, since consumption of ink in the liquid ejecting head 21 is suppressed, the pressure adjustment valve 25 maintains a closing state and pressure of ink is maintained between the second coupling portion 38*b* and the pressure adjustment valve 25.

Therefore, ink which has been pressurized by the circulation pump 47 flows to the fourth flow path 44 via the third coupling portion 38*c*, flows to the second flow path 42 via the first coupling portion 38*a*, and further flows to the fifth flow path 45 via the second coupling portion 38*b*. Therefore, when the circulation pump 47 is driven, ink circulates in the circulation flow path 48. Therefore, even when the ingredients have been precipitated and concentration imbalance has been caused, ink is stirred by flowing in the circulation flow path 48 and the concentration imbalance is alleviated.

The controller 55 stops driving of the circulation pump 47 at a time when concentration imbalance in the circulation flow path 48 is sufficiently resolved and subsequently, drives the feed pumps 37*c* and 37*d* corresponding to the supply cartridge (supply step).

Note that, hereinafter, a case is described where the third ink cartridge 29*c* is selected as a supply cartridge and the fourth ink cartridge 29*d* is a non-supply cartridge.

When the third feed pump 37*c* which corresponds to the third ink cartridge 29*c* is driven, ink in the first flow path 41 is pressurized to a downstream side and the applied pressure acts on the other second flow path 42 to the sixth flow path 46. Further, when the third feed pump 37*c* is driven, the fourth feed pump 37*d* and the circulation pump 47 are stopped. Therefore, in ink, pressure is accumulated between the first coupling portion 38*a* and the fourth feed pump 37*d*, between the third coupling portion 38*c* and the circulation pump 47, and between the second coupling portion 38*b* and the circulation pump 47.

Therefore, when ink is consumed in the liquid ejecting head 21 and the pressure adjustment valve 25 is opened, ink which has been housed in the third ink cartridge 29*c* is supplied to the liquid ejecting head 21 side via the first flow path 41, the second flow path 42, and the third flow path 43. That is, with the supply of ink, ink in the first flow path 41 to the third flow path 43 flows and precipitation in ink is suppressed in comparison with ink in the fourth flow path 44 to the sixth flow path 46 in which ink does not flow.

Next, a case where the fourth ink cartridge 29*d* is selected as a supply cartridge and the third ink cartridge 29*c* is a non-supply cartridge will be explained.

When the fourth feed pump 37*d* which corresponds with the fourth ink cartridge 29*d* is driven, ink in the sixth flow path 46 is pressurized to a downstream side and the applied pressure acts on the first flow path 41 to the fifth flow path 45. Further, when the fourth feed pump 37*d* is driven, the third feed pump 37*c* and the circulation pump 47 are stopped. Therefore, in ink, pressure is accumulated between the first coupling portion 38*a* and the third feed pump 37*c*, between the third coupling portion 38*c* and the circulation pump 47, and between the second coupling portion 38*b* and the circulation pump 47.

Therefore, when ink is consumed in the liquid ejecting head 21 and the pressure adjustment valve 25 is opened, ink which has been housed in the fourth ink cartridge 29*d* is supplied to the liquid ejecting head 21 side via the sixth flow path 46, the fourth flow path 44, the second flow path 42, and the third flow path 43. That is, with the supply of ink, ink in the second flow path 42 to the fourth flow path 44 and the sixth flow path 46 flows and precipitation in ink is suppressed in comparison with ink in the first flow path 41 and the fifth flow path 45 in which ink does not flow.

Next, a case where both of the third ink cartridge 29*c* and the fourth ink cartridge 29*d* are selected as supply cartridges will be explained.

When the third feed pump 37*c* and the fourth feed pump 37*d* are driven, ink in the first flow path 41 and in the sixth flow path 46 is pressurized to a downstream side and applied pressure acts on the second flow path 42 to the fifth flow path 45. Note that, since the circulation pump 47 is stopped at this time, pressure is accumulated in ink between the third coupling portion 38*c* and the circulation pump 47 and between the second coupling portion 38*b* and the circulation pump 47.

Therefore, when ink is consumed in the liquid ejecting head 21 and the pressure adjustment valve 25 is opened, ink that has been housed in the third ink cartridge 29*c* is supplied to the second flow path 42 via the first flow path 41. On the other hand, ink that has been housed in the fourth ink cartridge 29*d* is supplied to the second flow path 42 via the sixth flow path 46 and the fourth flow path 44. Then, ink that has been supplied from the third ink cartridge 29*c* and that has been supplied from the fourth ink cartridge 29*d* is supplied to the liquid ejecting head 21 side in a mixed state at the time when ink flows in the second flow path 42 and the third flow path 43. That is, with the supply of ink, ink flows in the first flow path 41 to the fourth flow path 44 and the sixth flow path 46, and precipitation in ink is suppressed in comparison with ink in the fifth flow path 45 in which ink does not flow.

Then, a pressure of supplied ink is each adjusted at the valve unit 24 and ink is ejected to the recording paper S which is supported by the support member 13 through a nozzle of the liquid ejecting head 21, thereby performing printing for forming images, and so on.

Next, an action when the maintenance mechanism 22 performs maintenance of the liquid ejecting head 21 will be explained.

The controller 55 measures time ink has not been supplied from the non-supply cartridge by measuring elapsed time from the previous maintenance process (measuring step).

Then, the controller 55 performs maintenance process in the case where the measured time is longer than a predetermined time (a day, for instance). Note that a predetermined time is a time that is set in advance and during the time concentration imbalance being caused when ink does not flow. That is, the controller 55 stops driving of the feed pumps 37*c* and 37*d* and then drives the circulation pump 47. Then, since ink circulates in the circulation flow path 48, even when concentration imbalance in ink has been caused in the circulation flow path 48, the imbalance is alleviated.

The controller 55 stops driving of the circulation pump 47 at a time when concentration imbalance in the circulation flow path 48 is sufficiently resolved, and then, drives the feed pump corresponding to the non-supply cartridge. That is, for instance, when the third ink cartridge 29*c* is a supply cartridge, the fourth feed pump 37*d* corresponding to the fourth ink cartridge 29*d* that is a non-supply cartridge is driven.

Note that, since the circulation pump 47 is stopped and the pressure adjustment valve 25 is closed at this time, a flow from the sixth flow path 46 to another flow path is not caused. Ink flows in the sixth flow path 46 to alleviate concentration imbalance (flow step). Therefore, at this time, the fourth feed pump 37*d* functions as an example of the flow mechanism.

Further, the controller 55 drives the moving mechanism 52, situates the cap 51 in an abutting position and then drives the suction pump 53. Then, the pressure adjustment valve 25 is opened and ink is supplied from the fourth ink cartridge 29*d*. In addition, ink in the sixth flow path 46, the fourth flow path 44, the second flow path 42, and the third flow path 43 flows from an upstream side to a downstream side (flow step). Therefore, at this point, the maintenance mechanism 22 functions as an example of a flow mechanism which causes ink in the sixth flow path 46 to flow from an upstream side to a downstream side. Then, the controller 55 stops driving of the suction pump 53 at a time when ink in the sixth flow path 46 finishes flowing from the sixth flow path 46 to the fourth flow path 44 and drives the moving mechanism 52 to move the cap 51 to the distanced position.

Further, the controller 55 stops driving of the fourth feed pump 37*d* and drives the circulation pump 47. Then, ink which has been moved from the sixth flow path 46 to the circulation flow path 48 flows in the circulation flow path 48 to reduce the concentration imbalance. Thereafter, the controller 55 stops driving of the circulation pump 47 and drives the third feed pump 37*c* corresponding to the third ink cartridge 29*c* that is a supply cartridge.

On the other hand, when the third ink cartridge 29*c* is a non-supply cartridge, the controller 55 drives the circulation pump 47 and drives the third feed pump 37*c*. Therefore, the third feed pump 37*c* also functions as an example of the flow mechanism.

Next, with respect to the composition of ink, particularly white ink that includes white pigments will be explained. Note that, in white ink, not only pigment ingredient of pigment ink but also dye ingredient which does not solve in ink solvent sometimes precipitate, depending on difference in specific gravity.

As white pigments, not limited to specific material, but known material can be used. Examples thereof include lead basic carbonate ($2PbCO_3Pb(OH)_2$, a so-called silver white), zinc oxide (ZnO, a so-called zinc white), titanium oxide ($TiO_2$, a so-called titan white), strontium titanate ($SrtiO_3$, a so-called titan strontium white), empty particles, and so forth.

Note that surface treatment may be performed on these white pigments according to the necessity.

Titanium oxide is small in specific gravity, large in refraction index, and stable chemically and physically in comparison with other white pigments, and therefore, as pigment, its hiding power and coloring power is strong and it has excellent durability to acid, alkali, and other environments. Therefore, as white pigments, titanium oxide is preferably used. Of course, other pigments (those other than white pigments listed above) may be used according to the necessity.

Titanium oxide is not particularly limited and any titanium oxide is selected for use from among known titanium oxides that are used as white pigments. Any one of rutile-type titanium oxide and anatase-type titanium oxide can be used and, rutile type titanium oxide is preferably used because it is low in catalyst activity power and excellent in aging stability.

Titanium oxide has been in the market and followings can be cited as examples: Tipaque CR60-2, Tipaque A-220 (all are manufactured by Ishihara Sangyo Co., Ltd.), KRONOS1001, 1014, 1071, 1074, 1075, 1077, 1078, 1080, 1171, 2044, 2047, 2056, 2063, 2080, 2081, 2084, 2087, 2160, 2190, 2211, 2220, 2222, 2225, 2230, 2233, 2257, 2300, 2310, 2450, 2500, 3000, and 3025 (all are manufactured by KRONOS).

Also, as to white pigments, surface treatment may be performed according to the necessity. More specifically, silica, alumina, zinc, zirconia, or organic matter treatment is performed. Weatherability, lipophilic or hydrophilic property differs according to a treating method. In this invention, those to which an alumina, zinc, zirconia, or basic organic matter treatment is performed are preferable.

As empty particles, empty polymer particles can be exemplified. Further, as empty polymer particles, resin particles whose inside are empty can be exemplified (see JP-A-2009-35672).

Further, empty particles have been in the market. For instance, SX866(A) (manufactured by JSR Corporation), or the like can be exemplified.

For dispersion of white pigments, following dispersion devices can be used: a ball mill, a sand mill, an attritor, a roll mill, a jet mill, a homogenizer, a paint shaker, a kneader, an agitator, a Henschell mixer, a coloid mill, an ultrasonic homogenizer, a pearl mill, a wet process jet mill, and so forth.

Further, when adding white pigment on ink composition, it is possible to use synergist corresponding to each kind of pigments as dispersion assistant. As dispersion assistant, 1 to 50 weight thereof is preferably added to white pigments of 100 weight.

In ink composition, as dispersion medium of various ingredients like white pigments, solvent may be added. Further, in absence of solvent, polymerizable compound that is low-molecular weight component (described later as component B) may be used as dispersion medium. Particularly, as dispersion medium, polymerizable compound whose viscosity is the lowest is preferably selected in view of dispersion property and improvement of handling property of ink compositions.

Particle size of white pigments is preferably 0.1 to 0.5 μm, more preferably 0.1 to 0.3 μm, further more preferably 0.15 to 0.25 μm. Further, the largest particle size is preferably less than or equal to 1 μm, more preferably less than or equal to 0.5 μm. It is preferable to select white pigments, dispersant, and dispersion medium and to set dispersion condition and filtration condition so that the largest particle size be within the above range. Further, it is effective to remove large particles in a later process like a centrifugal separation process. Due to this particle size management, it is possible to suppress clogs occurring in the head nozzle and to maintain preservation stability (particularly, suppression of precipitation) of ink and sufficient hiding properties and curing sensitivity.

It is possible to measure the particle size of white pigments in ink composition by a known measurement method. More specifically, the particle size can be measured by the centrifugal settlement light transmission method, X-ray transmission method, laser diffraction/diffusion method, dynamic light diffusion method, and so forth.

One kind of white pigment may be used alone, or two or more kinds of white pigments may be used in combination.

As to content of white pigments, 10 to 50 weight % is preferable with respect to all weight of ink composition, 10 to 40 weight % is more preferable, 12 to 30 weight % is further more preferable. In the above range, it is excellent in hiding ratio, cured property, and particularly, cured property in a cured film.

According to the above embodiments, following effects can be obtained.

1. In ink in the flow paths 41 to 46, concentration imbalance gradually becomes large in accordance with a length of stopping time. Therefore, in the first flow path 41 and the sixth flow path 46 corresponding to the ink cartridges 29*c* and 29*d* that do not supply ink for a predetermined time, concentration imbalance may be large in ink. At this point, since the feed pumps 37*c* and 37*d* cause ink to flow in the first flow path 41 and the sixth flow path 46, it is possible to reduce the concentration imbalance in ink in the first flow path 41 and the sixth flow path 46.

2. By causing ink to flow from an upstream side to a downstream side, it is possible to cause ink to largely flow in comparison with a case where ink flows in the first flow path 41 and the sixth flow path 46. Therefore, it is possible to effectively reduce concentration imbalance in ink.

3. Concentration of ink that is supplied from the ink cartridges 29*c* and 29*d* sometimes varies depending on the residual amount of ink that is housed in the ink cartridges 29*c* and 29*d*. That is, in the case where the residual amount is large, ink whose concentration is lower than in a case where the residual amount is small is sometimes supplied. At this point, by supplying ink from a small amount cartridge in which the residual amount of ink is less than or equal to the threshold of residual amount and a large amount cartridge in which the residual amount of ink is above the threshold of residual amount, it is possible to mix inks whose concentrations are different from each other and supply the mixed ink to the liquid ejecting head 21.

4. Since ink flows in the first flow path 41 and the sixth flow path 46 corresponding to the ink cartridges 29*c* and 29*d* when the time ink is not supplied has elapsed for a predetermined time, it is possible to suppress concentration imbalance in ink in the first flow path 41 and the sixth flow path 46. Therefore, when the residual amount of ink becomes small in the ink cartridges 29*c* and 29*d*, and ink is supplied from the large amount cartridge, it is possible to supply ink whose concentration imbalance is suppressed.

Further, the above embodiments may be varied as follows.

Figure 3:
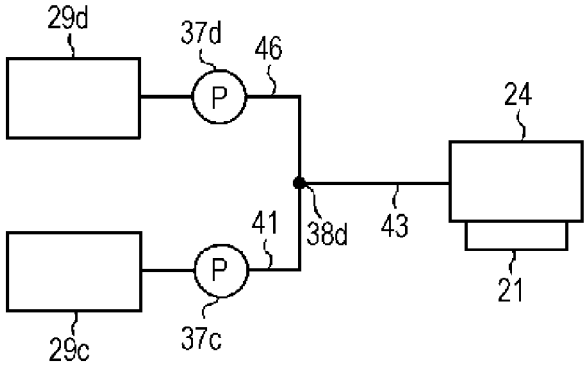
FIG. 3 is a schematic diagram of a flow path of a variation.

As illustrated in FIG. 3, the circulation flow path 48 and the circulation pump 47 might not be provided (variation). That is, the first flow path 41, the sixth flow path 46, and the third flow path 43 may be coupled via the fourth coupling portion 38*d*. In this case, the first flow path 41 and the sixth flow path 46 function as an example of the housing portion side flow path and the third flow path 43 functions as an example of the head side flow path.

In the above embodiments, the downstream end 41*b* of the first flow path 41 and the downstream end 46*b* of the sixth flow path 46 may be coupled to any one of the second flow path 42 to the fifth flow path 45. Further, the downstream end 41*b* of the first flow path 41 may be coupled to the sixth flow path 46, and the downstream end 46*b* of the sixth flow path 46 may be coupled to the first flow path 41.

In the above embodiments, the feed pumps 37*a* to 37*f* may be a pressurizing pump for pushing ink from the ink cartridges 29*a* to 29*f* by pressurizing ink in the ink cartridges 29*a* to 29*f*. Further, the feed pumps 37*a* to 37*f* might not be provided, and ink may be supplied due to water head difference. Further, in this case, a valve is preferably provided to each of the first flow path 41 and the sixth flow path 46 to select the supply cartridge or the non-supply cartridge by opening the valve. That is, while the ink cartridge on a side where the valve is opened becomes the supply cartridge and the ink cartridge on a side where the valve is closed becomes the non-supply cartridge.

In the above embodiments, two or more ink cartridges may be coupled to the liquid ejecting head 21 that is capable of ejecting ink from same nozzles. Further, the ink cartridge that is newly mounted may be coupled to any of the flow paths 41 to 46. When the ink cartridge is newly mounted, a flow path portion between the ink cartridge that is newly mounted and the current flow paths 41 to 46 functions as an example of the housing portion side flow path. Further, the third ink cartridge 29*c* and the fourth ink cartridge 29*d* need not be the same ink cartridges if the same kind of ink is housed therein. For instance, a shape and an allowable amount of housing ink may be different. Further, when three or more ink cartridges are mounted, these three or more ink cartridges may be selected as the supply cartridges. For instance, all of the ink cartridges may be selected as the supply cartridges.

In the above embodiments, irrespective of the residual amount of ink in the ink cartridges 29*c* and 29*d*, when a time that ink is not supplied from the ink cartridges 29*c* and 29*d* has elapsed for a predetermined time, maintenance of the liquid ejecting head 21 may be performed. Further, when a time that ink is not supplied from the supply cartridge has elapsed for a predetermined time, a maintenance process for supplying ink from the supply cartridge may be performed.

In the above embodiments, irrespective of the residual amount of ink in the ink cartridges 29*c* and 29*d*, the ink cartridge that is selected as the supply cartridge may be one. Further, the threshold of residual amount at the time of determining the small amount cartridge and the threshold of residual amount at the time of determining the large amount cartridge may be different.

In the above embodiments, by causing part of ink to flow in the first flow path 41 and the sixth flow path 46 to a downstream side flow path (circulation flow path 48), concentration imbalance in ink may be alleviated. Further, after ink in the first flow path 41 and the sixth flow path 46 has been caused to flow to the circulation flow path 48, the circulation pump 47 might not be driven.

In the above embodiments, only by flowing ink in the first flow path 41 and the sixth flow path 46, concentration imbalance in ink may be alleviated. That is, the maintenance mechanism 22 might not function as the flow mechanism.

In the above embodiments, ink may be ejected from the liquid ejecting head 21 with the feed pump corresponding to the non-supply cartridge being driven, and ink may flow in a flow path corresponding the non-supply cartridge. That is, for instance, when the third ink cartridge 29*c* is a non-supply cartridge, ink may be ejected from the liquid ejecting head 21 with the third feed pump 37*c* being driven, and ink in the first flow path 41 may flow from an upstream side to a downstream side. In this case, the liquid ejecting head 21 functions as an example of the flow mechanism.

In the above embodiments, a vibration device for vibrating the first flow path 41 and the sixth flow path 46 and a heater for heating them may be mounted as an example of the flow mechanism. That is, by vibrating the first flow path 41 and the sixth flow path 46, ink in the flow path may flow. Further, by heating ink to cause convection (flow), concentration imbalance in ink may be alleviated.

In the above embodiments, a predetermined time that is set in advance in the case of concentration imbalance being caused when ink is stopped may be changed in accordance with the kinds of ink. That is, for instance, in the case of pigment ink, it may be a half day, and in the case of dye ink, it may be two days. Further, it may be set for each color of ink. For instance, in the case of cyan ink, it may be 20 hours, and in the case of magenta ink, it may be 30 hours.

In the above embodiments, the first flow path 41 to the sixth flow path 46 may be composed of a member having stiffness regardless of the third ink supply tube 33 having flexibility. That is, the flow paths 41 to 46 may be formed by bonding a film on a member to which a concave is formed, for instance, so as to cover the concave. Further, the flow paths 41 to 46 may be composed of both of a member having flexibility and a member having stiffness. Further, the first tube 33*a* to the sixth tube 33*f* may be bonded to each other with adhesive. That is, the coupling portions 38*a* to 38*c* need not be separate members and may be portions in which the flow paths 41 to 46 cross.

In the above embodiments, two or more ink cartridges in which the same ink is housed may be connectable to the ink supply tubes 31, 32, 34, and 35 in addition to the third ink supply tube 33.

In the above embodiments, the circulation pump 47 may be mounted at any location in the circulation flow path 48. That is, the circulation pump 47 may be mounted on the second flow path 42 or the fourth flow path 44. Further, a direction in which the circulation pump 47 circulates ink may be inverted. That is, ink is supplied from the fifth flow path 45 to the second flow path 42 and ink may be circulated in a direction for supplying ink from the second flow path 42 to the fourth flow path 44.

In the above embodiments, the printer 11 may be a so-called gantry type printer for moving the body case 12 and the cartridge holders 26 and 27 with respect to the recording paper S in a stopping state to perform printing. In such a printer, it is not possible to exchange ink cartridges during printing but it is possible to continue printing by using ink that is supplied from the ink cartridge which is different from the one that has run out of ink. Further, since in supplied ink, concentration imbalance is alleviated, it is possible to suppress degradation of printing quality.

In the above embodiments, the liquid ejecting apparatus may be the one for ejecting or discharging liquid other than ink. Further, the state of the liquid which is ejected as minute drops from the liquid ejecting apparatus includes granule forms, tear-drop forms, and forms that pull tails in a string-like form therebehind. Further, "liquid" here may be material which can be ejected from the liquid ejecting apparatus. For instance, the material may be liquid phase. It may include liquid with high or low viscosity, fluid like sol, gel water, other inorganic solvents, organic solvents, solutions, liquid resins, liquid metals (metallic melts). Further, it may include not only liquid as a single state of a matter but also solvents in which a functional material composed of solid body like pigments and metal particles are solved, scattered or mixed. Representative examples of the liquid include ink which is explained in the above embodiments, liquid crystals, and so forth. Here, "ink" includes various liquid compositions such as general water-based inks and oil-based inks, gel inks, and hot-melt inks. A concrete example of the liquid ejecting apparatus includes a liquid ejecting apparatus for ejecting liquid which contains material like electrode materials or color materials used for manufacture of a liquid crystal display, an EL (Electro Luminescent) display, a surface emitting display, a color filter and so forth in the scattered or solvent forms. Further, it may be a liquid ejecting apparatus for ejecting bioorganic matters used for bio chip manufacture, a liquid ejecting apparatus for ejecting liquid which is a sample used as a precision pipette, a print apparatus or a micro dispenser, and so forth. Further, it may be a liquid ejecting apparatus for ejecting lubricant on precision machines like a clock or a camera at a pinpoint timing, or a liquid ejecting apparatus for ejecting a transparent resin like an ultraviolet curing resin on a substrate so as to form a minute hemispheric lens (optical lens) used for an optical communication device etc. Further, it may be a liquid ejecting apparatus for ejecting acid or alkali etching solution so as to etch a substrate.

The entire disclosure of Japanese Patent Application No. 2013-068273, filed Mar. 28, 2013 is expressly incorporated by reference herein.

What is claimed is:

1. A liquid ejecting apparatus comprising:

a liquid ejecting head that ejects liquid which is supplied from two or more liquid housing portions that house liquid;

two or more housing portion side flow paths which are provided to correspond with each of the liquid housing portions and which supply liquid from an upstream side that is a side of the liquid housing portions to a downstream side that is an opposite side to the liquid housing portions;

a head side flow path which supplies liquid supplied by each of the housing portion side flow paths further to a downstream side that is a side of the liquid ejecting head; and a flow mechanism which is capable of causing liquid to flow in the housing portion side flow paths, wherein the flow mechanism causes liquid to flow in a housing portion side flow path corresponding with a liquid housing portion that does not supply liquid for a predetermined time set in advance among the housing portion side flow paths.

2. The liquid ejecting apparatus according to claim 1, wherein the flow mechanism causes the liquid in the housing portion side flow paths to flow from an upstream side to a downstream side.

3. The liquid ejecting apparatus according to claim 1, further comprising:

a residual amount detector which detects a residual amount of liquid housed in the liquid housing portion; and a selector which selects the liquid housing portion that supplies liquid to the liquid ejecting head, wherein the selector selects, in the liquid housing portions, as a liquid housing portion which supplies liquid to a side of the liquid ejecting head, both a small amount liquid housing portion in which the residual amount of housed liquid is less than or equal to the threshold of residual amount and a large amount liquid housing portion in which the residual amount of housed liquid is larger than the threshold of residual amount.

4. The liquid ejecting apparatus according to claim 3, wherein the flow mechanism, when the residual amount of liquid housed in each of the liquid housing portions is larger than the threshold of residual amount, causes the liquid to flow in the housing portion side flow path corresponding to the liquid housing portion when time that liquid is not supplied has elapsed for the predetermined time.

5. A liquid supplying method for a liquid ejecting apparatus comprising:

supplying liquid via a supply liquid housing portion which supplies liquid to a liquid ejecting head among two or more liquid housing portions that house liquid, a housing portion side flow path corresponding to the supply liquid housing portion, and a head side flow path on a side closer to the liquid ejecting head than the housing portion side flow path;

measuring time when liquid is not supplied from a non-supply liquid housing portion that is different from the supply liquid housing portion among the liquid housing portions; and causing liquid to flow in a housing portion side flow path corresponding to the non-supply liquid housing portion when time measured in the measuring is longer than a predetermined time set in advance.

* * * * *